US009653280B2

(12) United States Patent
Muelders et al.

(10) Patent No.: US 9,653,280 B2
(45) Date of Patent: May 16, 2017

(54) ELECTRODE FOR USE IN A LAMP

(75) Inventors: Barbara Roswitha Muelders, Aachen (DE); Reiner Feder, Simmerath (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 503 days.

(21) Appl. No.: 13/516,301

(22) PCT Filed: Dec. 10, 2010

(86) PCT No.: PCT/IB2010/055707
§ 371 (c)(1),
(2), (4) Date: Jun. 15, 2012

(87) PCT Pub. No.: WO2011/073862
PCT Pub. Date: Jun. 23, 2011

(65) Prior Publication Data

US 2012/0256539 A1 Oct. 11, 2012

(30) Foreign Application Priority Data

Dec. 18, 2009 (EP) ..... 09179788

(51) Int. Cl.
*H01J 9/26* (2006.01)
*H01J 61/36* (2006.01)
(Continued)

(52) U.S. Cl.
CPC ..... *H01J 61/368* (2013.01); *H01J 9/326* (2013.01); *H01J 61/0732* (2013.01)

(58) Field of Classification Search
CPC ..... H01J 61/368; H01J 61/0732
(Continued)

(56) References Cited

U.S. PATENT DOCUMENTS 5,404,078 A * 4/1995 Bunk ..... H01J 9/323 313/623
6,452,334 B1 9/2002 Ohshima
(Continued)

FOREIGN PATENT DOCUMENTS

CN 1391254 A 1/2003
CN 101523550 A 9/2009
(Continued)

OTHER PUBLICATIONS

First Office Action, China Application No. 201080057774.8, dated Sep. 3, 2014, 28 pages.
(Continued)

*Primary Examiner* — Nimeshkumar Patel
*Assistant Examiner* — Christopher Raabe
(74) *Attorney, Agent, or Firm* — Brian D. Ogonowsky; Patent Law Group LLP

(57) ABSTRACT

The invention describes an electrode (1) for use in a lamp (3) comprising a quartz glass envelope (30) enclosing a chamber (31), which electrode (1) comprises a tip for extending into the chamber (31) and base for embedding in a sealed portion (33) of the quartz glass envelope (30), characterized in that the base comprises a plurality of essentially smooth concave channels (2) arranged around the body of the electrode (2) and wherein the depth ($d_{ch}$) of a channel (2) is preferably at most 8 percent, more preferably at most 5 percent, most preferably at most 3 percent of a diameter ($D_e$) of the electrode (2). The invention further describes a method of manufacturing an electrode (1) for use in a lamp (3) comprising a chamber (11) in a quartz glass envelope (30), which method comprises the step of removing material from the body of the electrode (1) to form a plurality of channels (2) around the body of the electrode such that a channel (2) comprises channel side walls (62) and an
(Continued)

essentially concave channel floor (60), and such that depth ($d_{ch}$) of a channel (2) is preferably at most 8 percent, more preferably at most 5 percent, most preferably at most 3 percent of a diameter ($D_e$) of the electrode (2). The invention also describes a lamp (3) comprising such electrodes (1), and a method of manufacturing such a lamp (3).

14 Claims, 4 Drawing Sheets

(51) Int. Cl.
*H01J 9/32* (2006.01)
*H01J 61/073* (2006.01)

(58) Field of Classification Search
USPC ..... 313/623
See application file for complete search history.

(56) References Cited

U.S. PATENT DOCUMENTS

| | | | | |
|---|---|---|---|---|
| 9,093,256 | B2 * | 7/2015 | Muelders | H01J 61/0732 |
| 2001/0005117 | A1 * | 6/2001 | Nishida | H01J 5/26 315/111.11 |
| 2002/0190654 | A1 * | 12/2002 | Kanzaki | H01J 61/86 313/623 |
| 2003/0042856 | A1 * | 3/2003 | Kaneko | C03C 3/085 313/639 |
| 2006/0208635 | A1 | 9/2006 | Lenef | |
| 2007/0103081 | A1 | 5/2007 | Boroczki | |
| 2007/0296339 | A1 * | 12/2007 | Grundmann et al. | 313/623 |
| 2008/0185950 | A1 * | 8/2008 | Claus et al. | 313/267 |
| 2008/0315771 | A1 | 12/2008 | Tsukamoto | |
| 2010/0045183 | A1 * | 2/2010 | Deprez | H01J 9/323 313/631 |
| 2010/0201265 | A1 * | 8/2010 | Ishikawa et al. | 313/623 |
| 2010/0270921 | A1 * | 10/2010 | Shirakawa et al. | 313/623 |
| 2010/0295448 | A1 * | 11/2010 | Takagaki et al. | 313/623 |
| 2010/0295449 | A1 * | 11/2010 | Shido | H01J 61/368 313/623 |
| 2011/0260613 | A1 * | 10/2011 | Deguchi et al. | 313/637 |
| 2014/0232260 | A1 * | 8/2014 | Muelders | 313/631 |

FOREIGN PATENT DOCUMENTS

| | | | |
|---|---|---|---|
| DE | 102005013759 | A1 | 9/2006 |
| DE | 102007010607 | A1 | 9/2008 |
| EP | 1271595 | A1 | 1/2003 |
| EP | 2254144 | A2 | 11/2010 |
| JP | 2001-015067 | A | 1/2001 |
| JP | 2004311034 | A | 4/2004 |
| JP | 2008235128 | A | 10/2008 |
| JP | 2009122318 | A | 6/2009 |
| WO | WO-2006099850 | A2 | 9/2006 |
| WO | 2007122535 | A2 | 11/2007 |
| WO | 2008032247 | A1 | 3/2008 |
| WO | 2009025073 | A1 | 2/2009 |
| WO | 2008119375 | A1 | 10/2009 |

OTHER PUBLICATIONS

Office Action, European Application No. 10809057.2, dated Mar. 3, 2015, 5 pages.
Office Action, Japan Application No. 2012-543951, dated May 12, 2015, 6 pages.
Second Office Action, China Application No. 201080057774,8, dated May 6, 2015, 25 pages.
EPO as ISA, PCTIB2010/055707, filed Dec. 10, 2010, "International Search Report and Written Opinion", mailed May 6, 2011, 12 pages.
Fourth Office Action, China Application No. 201080057774.8, dated Mar. 3, 2016, 8 pages.
Office Action, European Application No. 10809057.2, dated Jul. 13, 2015, 5 pages.
Third Office Action, China Application No. 201080057774.8, dated Nov. 4, 2015, 26 pages.

* cited by examiner

ELECTRODE FOR USE IN A LAMP

FIELD OF THE INVENTION

The invention describes an electrode for use in a lamp and a method of manufacturing such an electrode. The invention further describes a lamp and a method of manufacturing a lamp.

BACKGROUND OF THE INVENTION

In lamps such as gas-discharge lamps or halogen lamps, the body of the lamp is often made of quartz glass and encloses a burner or chamber with a filling. In the case of lamps such as a high-intensity discharge (HID) lamp, the fill gas or filling can comprise an inert gas as well as various metal salts. The electrodes, usually embedded in a sealed portion of the lamp, can become very hot on account of the high current that flows through the electrode during switch-on and during operation of the lamp. The hot electrodes cause the quartz glass to also heat up. The different coefficients of thermal expansion of the quartz glass and the electrode metal lead mean that these expand and contract at different rates during heating and cooling respectively. A known problem caused by these different expansion and contraction rates is that cracks appear in the quartz glass, since quartz glass expands and contracts to a lesser extent than metal. During the lifetime of the lamp, the cracks can become larger. For example, a number of small cracks can spread and join to form an enclosed region in the sealed portion in the form of a 'bead'. Also, one or more small cracks can develop into a crack extending radially outward, known as a 'radially extending crack' or REC. A bead-like crack can also develop into a REC. Such cracks can ultimately lead to failure of the lamp or, in a worst case, to explosion of the lamp.

Much effort has been invested in finding a solution to the problem of lamp failure due to cracks in the sealed portion, since long lifetime and reliability of performance are extremely important factors, particularly in the case of gas-discharge lamps used for automotive purposes. Some efforts describe wrapping a coil around the electrode in the region that will be enclosed in the sealed portion. Such techniques are time-consuming and expensive, and therefore not practicable. In one approach, US 2007/0103081 describes an electrode treated so that cracks largely develop in a controlled manner. This document teaches the treatment of the electrode, for example by creating a deep pit in the electrode or a deep groove around the body of the electrode, in order to deliberately allow a bead-like crack to develop during operation of the lamp. However, observations have shown that such grooves in the electrodes are associated with a high proportion of electrode breakages, even during the manufacturing process, so that this type of electrode treatment is not particularly advantageous from the point of view of a prolonged lamp lifetime as well as a desirable production yield.

Other approaches are based on minimizing the contact between the electrode body and the quartz glass in the sealed portion. For example, WO 2008/032247 describes electrodes treated so that bristle-like protrusions, arranged in a spiral manner on the sides of grooves running around the electrode, result in a separation between quartz glass and electrode in a critical part of the sealed portion that is most subject to extreme temperatures during operation of the lamp. However, this type of electrode is also associated with an undesirably high failure rate, resulting in shorter life-time and an undesirably low production yield. The reason for this is that, to reach the necessary high pressure of inert gas in the lamp, a cooling step is required during manufacture. Cooling is carried out rapidly, for example by immersing the seal (or the entire lamp) in a liquid nitrogen bath. This means that, in the sealed portion, the quartz glass and the electrode both contract, but the electrode contracts to a greater extent. While the electrode contracts, axial forces are exerted on the electrode, which arise as a result of the adherence between the quartz glass and the electrode in the sealed portions on either side of the critical region. In effect, the grooved region is being held firmly at both ends, while at the same time being forced to contract. The relatively deep groove in the body of the electrode causes the electrode to behave as a notched tensile specimen. Often, this results in the groove developing into a crack or break in the body of the electrode during cooling, and the lamp is rendered useless. The same applies to US 2007/0103081, since any deep pit or groove in the body of the electrode increases the likelihood of failure during cooling.

It is therefore an object of the invention to provide an improved electrode which reduces the lifetime-related and production-related problems outlined above.

SUMMARY OF THE INVENTION

This object is achieved by the electrode of claim 1, the method of claim 7 of manufacturing such an electrode, the lamp according to claim 10, and the method according to claim 12 of manufacturing such a lamp.

According to the invention, the electrode for use in a lamp comprises a quartz glass envelope enclosing a chamber, which electrode comprises a tip for extending into the chamber and a base for embedding in a sealed portion of the quartz glass envelope, and the electrode is characterized in that the base comprises a plurality of essentially smooth concave channels arranged around the body of the electrode, and wherein the depth of a channel is preferably at most 8 percent (8%), more preferably at most 5 percent (5%), and most preferably at most 3 percent (3%) of a diameter of the electrode.

Here, the expression "arranged around the body of the electrode" is to be understood to mean that the channels are arranged circumferentially or helically about the electrode, as opposed to a longitudinal arrangement. Furthermore, a channel arranged around the body of the electrode such that it "wraps around" the electrode several times is regarded in this context as a "plurality of channels", since, when viewed from any point along a side of the lamp, the electrode appears to comprise a plurality of channels. The term "smooth" in this context means that the channel floor is devoid of any 'pits' or 'holes', so that the channel floor is essentially uninterrupted by any such depressions or deeper areas.

An obvious advantage of the method according to the invention is that the channels formed in the body of the electrode ensure that the electrode, during a cooling step in manufacture, will not act as a notched tensile specimen and will therefore not be subject to critical stresses in the form of fracture stresses. This is because the shallow concave form of the channel increases the resistance of the electrode material to the triaxial stresses exerted on the electrode during cooling. This is in contrast to the prior art grooved electrodes, which, with their narrow, steeply pitched groves are more likely to break during cooling on account of the triaxial stresses being concentrated at the deepest part of the groove. Another advantage of the electrode according to the invention is that, since the depth of the channels is relatively shallow, the diameter of the electrode is only minimally reduced, so that a 'core' of the electrode is still large enough to withstand the forces exerted upon it during cooling. This is in contrast to prior art electrodes with deep grooves, or grooves with deep irregularities such as additional pits or holes, and a correspondingly narrow electrode core. These types of electrode may fail during a manufacturing cooling step since the narrow core of the electrode is often not large enough to withstand these forces.

The method according to the invention of manufacturing such an electrode for use in a lamp (comprising a chamber in a quartz glass envelope) comprises the step of removing material from the body of the electrode to form a plurality of essentially smooth concave channels around the body of the electrode such that the depth of a channel is at most 8 percent (8%), more preferably at most 5 percent (5%), and most preferably at most 3 percent (3%) of a diameter of the electrode. Here, the expression "removing material" can mean that the material is physically transferred from the channel to regions along the sides of the channel, or it can mean that electrode material is actually taken out of the electrode body, for example by being vaporized.

The lamp according to the invention comprises a quartz glass envelope enclosing a chamber and a pair of such electrodes disposed to extend into the chamber, and wherein each electrode is partially embedded in a sealed portion of the quartz glass envelope.

The method according to the invention of manufacturing a lamp comprises the steps of forming an envelope of molten quartz glass; forming a first sealed portion to partially embed such a first electrode in the sealed portion; introducing a filling into a chamber in the molten quartz glass; cooling the first sealed portion, and forming a second sealed portion to partially embed a second electrode and to seal the filling in the chamber.

In the manufacture of a lamp such as a HID lamp, first one electrode is pinched in a sealing portion, and then the filling is introduced into the chamber, which is then sealed. By cooling the first sealed pinch, the volume of the filling in the chamber is reduced. A second pinch can then be formed to embed the second electrode and to simultaneously reduce the volume of the chamber to the desired dimensions. When the lamp is complete, the filling thaws and the pressure increases accordingly.

The steps listed here need not be carried out in the order given, but can be carried out in any appropriate order. The advantage of the method according to the invention is that, during the cooling step, in which the sealed portion can be cooled slowly or rapidly to seal in the filling, the geometry of the channels arranged around the body of the electrode according to the invention is such that the triaxial stresses in the channels, arising as a result of the different cooling rates, can be successfully withstood by the electrode. This method is then associated with an advantageously higher production yield and prolonged lifetime, since the number of electrodes that crack during cooling can be greatly reduced.

The dependent claims and the subsequent description disclose particularly advantageous embodiments and features of the invention.

While the tip of the electrode can have any suitable shape, it is assumed in the following, without restricting the invention in any way, that the electrode body is essentially rod-shaped, and that the electrode is made of a suitable material such as tungsten.

The axial forces exerted on the electrode during cooling are deflected by the sides of the channel, as described above. A flatter channel cross-section may therefore be associated with an improved deflection of these forces. Therefore, in a preferred embodiment of the electrode according to the invention, the ratio of channel width to channel depth comprises at most 8:1, more preferably at most 5:1, and most preferably at most 2:1.

Since the channel floor is essentially concave, the geometry of the channel floor may be defined in terms of a radius or diameter. For example, that part of the channel comprising the channel floor can follow the shape of a segment of a circle. The triaxial stresses exerted on the electrode may best be withstood by a channel floor with a relatively flat curvature. Therefore, in a further preferred embodiment of the electrode according to the invention, the ratio of channel width to a diameter of the channel floor comprises at most 10:1, more preferably at most 2.0:1, and most preferably at most 1:1.

In the case of quartz glass lamps with embedded electrodes which become very hot during operation, it is known that, during operation of the lamp, the high temperatures of the electrode subject the quartz glass to stress, resulting in cracks in the sealed portion. Initially, attempts were made to avoid the development of cracks in the sealed portion, for example by aiming to reduce the contact between electrode and quartz glass by wrapping the electrode in a foil or coil. However, in experiments leading to the electrode and lamp according to the invention, it has been established that very small cracks in the quartz glass are in fact favorable, since these later act to absorb some of the forces acting on the glass as the electrode rapidly expands, therefore relieving the glass of some stress and actually preventing the spontaneous development of large cracks. For this reason, this type of micro-crack can be termed a "relief crack". To successfully 'grow' relief cracks during the cooling step in manufacture, it was found that the manner in which the channels are formed in the electrode plays an important role. In one further preferred embodiment of the electrode according to the invention, therefore, at a transition between the surface of the electrode and a channel, material of the electrode is deposited to form a plurality of brush-like protrusions. Such spikes or tufts can favor the development of the desired micro-cracks.

In another particularly preferred embodiment of the electrode according to the invention, in an alternative to the brush-like protrusions formed at the channel sides, material of the electrode is deposited as the sides of the channels to form a low ridge. This low ridge has been shown experimentally to give very favorable results, allowing the controlled growth of relief cracks during the cooling stage in manufacture. Preferably, such a ridge has a height of at most 20 μm, more preferably at most 10 μm, and most preferably at most 6 μm at a transition between the surface of the electrode and a channel. This material can be deposited by being displaced during the formation of the channel. For example, if the step of forming the channel results in the electrode material being heated and transformed into its molten state, the molten material can be deposited along the outer edges of the channel where it can later cool and harden. Preferably, the material is deposited smoothly, so that the transition between the surface of the electrode and the channel is in the form of a slightly rounded ridge.

Channels can be arranged around the electrode body in a number of ways. For example, for a rod-shaped electrode, a series of neighboring channels can be arranged in a parallel fashion, so that each channel lies on a circular circumference of the electrode body. Evidently, the thickness of the electrode, measured in a cross-section taken along the middle of a channel, would then reduced by twice the channel depth. Therefore, in a preferred embodiment of the invention, the channels are formed such that at least one channel is arranged in a helical fashion around the body of the electrode. Such a helical channel can wrap around the electrode any suitable number of times. Viewed from any vantage point, even a single such helical channel appears to be a plurality of channels. Evidently, two or more helical channels can be 'nested'. Another type of arrangement could even comprise channels arranged to run in opposite directions so that they intersect or cross over, given a cross-hatched pattern on the electrode surface.

While it is desirable, for the reasons already put forward, to reduce the contact areas between quartz glass and electrode in a critical region along the body of the electrode in the sealed portion, it is also desirable to ensure that the electrode is held firmly by the quartz glass. Therefore, in a further preferred embodiment of the invention, the base of the electrode comprises a region treated to comprise the plurality of channels, which channel region is flanked on at least one side by an untreated region in which the surface of the electrode is essentially smooth. In this smooth region, the quartz glass can satisfactorily adhere to the electrode surface. The lengths of the smooth regions and the channel region can be governed by the type of glass being used, the electrode material, and the type of lamp in question. All these factors contribute to the temperature that can be reached during operation of the lamp and therefore the stress to which the glass will be subject.

The channels can be formed in a number of ways. For example, the channels could be milled using an appropriate milling tool. However, since the electrode rod is rather fragile, being very thin, it is preferably not to unduly subject the electrode to mechanical forces. Therefore, in a particularly preferred embodiment of the invention, the channel is formed by directing a laser beam at the surface of the electrode to remove material of the electrode or to shift or move the material from the channel to give ridges or brush-like protrusions along the interface between the channel and the electrode outside surface. The laser beam is preferably generated such that material is only removed up to the desired depth of the channel. Preferably, the electrode is rotated and moved laterally while the laser beam is being directed at the electrode, so that the desired spiral channel is formed in the surface of the electrode.

Operating parameters of the laser will govern the rate at which the material of the electrode is transformed to its molten state. For example, a high power and high pulse frequency can result in the material being spattered out from the channel. This might be desirable if brush-like protrusions are to be formed.

Alternatively, the operating parameters of the laser for generating the laser beam are chosen such that a floor of the channel, made by removing material of the electrode, is essentially smooth. The skilled person will know how a laser is to be set up in order to achieve the desired effect. By appropriate choice of the laser operating parameters, the laser beam can be generated to transfer the electrode material into the molten state while at the same time ensuring that the molten material is 'gently' pushed to the sides where it is deposited in low ridges along the transition region between electrode surface and channel. Favorable results can be obtained by operating a q-switched solid state laser to give a pulsed laser beam with pulses of a duration in the range 10 ns to 80 ns, at a frequency between 10 kHz and 70 kHz.

The channels made in this fashion are particularly suited for use in lamps in which a very high electrode temperature is reached during operation, since the relief cracks formed during the cooling in the manufacturing stage will protect the lamp from failure due to bead-cracks or REC cracks during the lamp lifetime. Therefore, a preferred embodiment of the lamp according to the invention comprises a gas-discharge lamp in which the electrodes comprise tungsten rods with a diameter in the range of 200 μm to 500 μm and which are disposed in the lamp such that tips of the electrodes extend into the chamber from opposite sides, and the other end of each electrode is embedded in a sealed portion of the lamp such that channels arranged around the body of the electrode are enclosed in the sealed portion.

To manufacture a lamp according to the invention, the filling must be sealed in the sealed portion, and the electrodes must be embedded in the quartz glass. In a HID lamp, the electrodes intrude into the chamber from opposite sides, and two seals are formed. For a halogen lamp, on the other hand, both electrodes enter the chamber from the same side and are embedded in a single seal. For a HID lamp, in which the fill gas in the burner or chamber is under high pressure, the filling in the chamber is preferably frozen in a manufacturing step by exposing the partially completed lamp to liquid nitrogen, which may be directed over the parts to be cooled, or may be in the form of a 'bath' into which the parts to be cooled are briefly dipped or immersed. Cooling a sealed pinch region in liquid nitrogen results in the inert gas of the filling to be frozen, resulting in a smaller volume. After forming the second pinch, the inert gas of the filling returns to its gaseous state. In this way, the required fill gas pressure in the burner—usually in the region 10 to 20 bar—can be obtained.

BRIEF DESCRIPTION OF THE DRAWINGS

Other objects and features of the present invention will become apparent from the following detailed descriptions considered in conjunction with the accompanying drawings. It is to be understood, however, that the drawings are designed solely for the purposes of illustration and not as a definition of the limits of the invention.

In the diagrams, like numbers refer to like objects throughout. Elements of the diagrams are not necessarily drawn to scale.

DETAILED DESCRIPTION OF THE EMBODIMENTS

Figure 1:
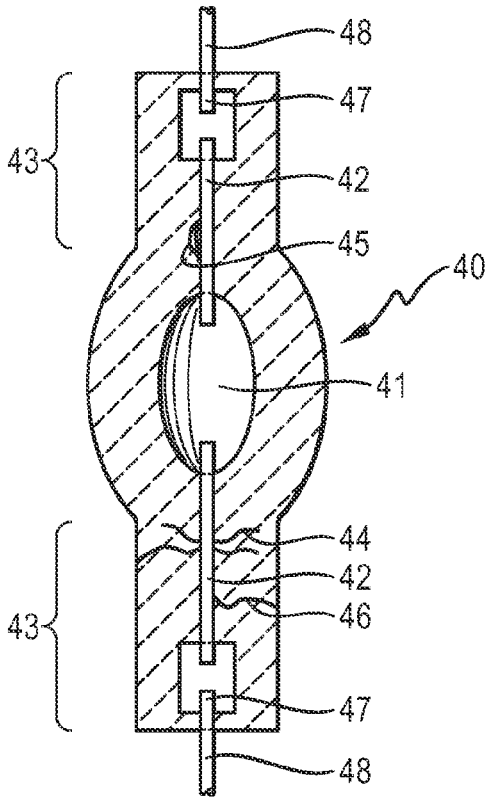
FIG. 1 (prior art)
FIG. 1 shows a prior art electrode in a sealed portion of a quartz glass lamp and a number of different cracks in the sealing portion of the type that arise during cooling.

FIG. 1 shows quartz glass gas-discharge lamp 40 with a discharge chamber 41. Two electrodes 42 protrude into the discharge chamber 41 and embedded in sealed portions 43 of the lamp 40. The end of the electrode 42 embedded in the sealed portion 43 is attached to a molybdenum foil 47, which in turn is connected to a lead-in wire 48. During operation, a voltage is applied across the lead-in wires 48 so that a discharge arc can be established between the tips of the electrodes 42 and so that a current can flow through the electrodes 42. The electrodes 42 become very hot during operation, causing the quartz glass in the sealed portions 43 to heat up as well. During a cooling step, but also during the lifetime of the lamp 40, cracks 44, 45, 46 can develop in the sealed portions 43 as a result of the different thermal expansion behavior of the electrode metal and the quartz glass. Initially, small cracks 44 may develop. As the lamp age progresses with use, some of the smaller bead-like cracks 45 may develop into radially extending cracks 46 Particularly the larger types of crack 45, 46 can lead to failure of the lamp 40.

Figure 2:
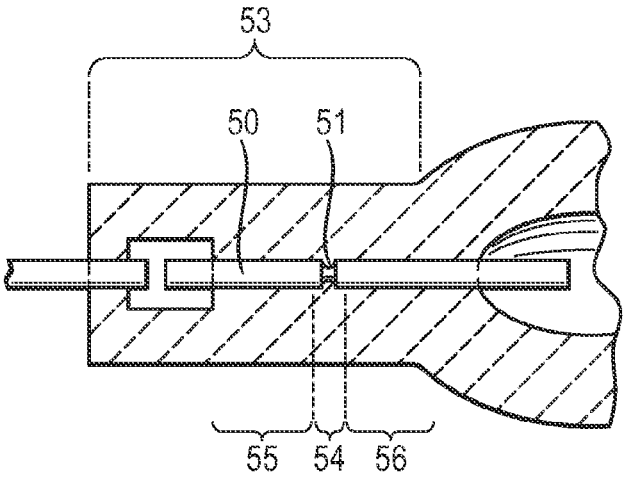
FIG. 2(prior art)
FIG. 2 shows an enlarged schematic view of a groove in a prior art electrode.
Figure 3:
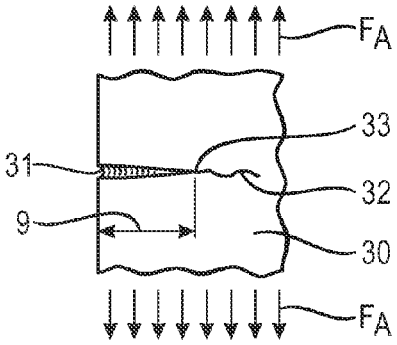
FIG. 3 is a schematic representation of a notched tension specimen.
Figure 4:
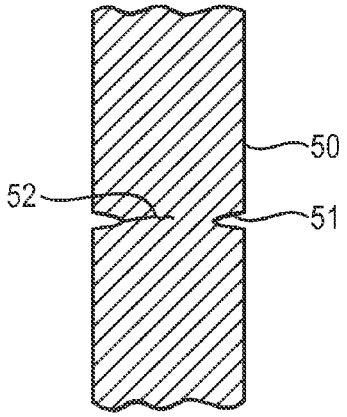
FIG. 4 shows an enlarged view of a groove in the electrode of FIG. 2 after failure during a cooling step in manufacture.

FIG. 2 shows an enlarged schematic view of a prior art electrode 50. This electrode 50 has been treated so that it has a number of relatively deep grooves 51 about its circumference in a region 54 of the sealed portion between a molybdenum foil and the discharge chamber. In known prior art electrodes 50 of this type, the depth of such a groove 51 is about 10% of the electrode diameter. The purpose of the grooves 51 is to lessen the mechanical stress exerted by the expanding electrode 50 when the temperature rises during operation. In lateral regions 55, 56 on either side of the grooved region 54, the body of the electrode 50 is left smooth and adheres to the quartz glass. However, as explained in the introduction, such grooves 51 lead to an unfavorable side-effect during manufacture. In effect, the deep grooves 51 cause the electrode 50 to behave as a notched tensile specimen during cooling, so that the electrode 50 is not able to withstand the resulting triaxial stresses in the notch 51. The forces acting on the electrode 50 during a cooling stage in manufacture are shown schematically in FIG. 3. Here, a tension specimen 30 with a notch 31 is being subject to axial loads $F_A$ exerted along an axis $A_e$. The notch 31 effectively weakens the specimen 30. If the axial forces $F_A$ are strong enough, the notch 31 will develop into a crack 32 in the body of the specimen 30, originating at the base 33 of the notch 31, and the specimen 30 will break. This behavior will be known to the skilled person and is described by Griffith's criterion, which, for brittle materials, relates the notch depth in a notched tension specimen to the critical tensile force (i.e. the force at which the specimen fails). Most metals, when cooled, behave as brittle materials, so that this criterion can also be applied to explain the tendency of such electrodes 50 to fail during cooling. FIG. 4 shows a close-up of the electrode 50 of FIG. 2 after failure during such a cooling step in manufacture. Axial loads $F_A$ were exerted on the electrode 50 along its axis $A_e$ on account of the forces of adhesion $F_Q$ between the quartz glass and the surface of the electrodes 50 in regions 55, 56 on either side of the grooved region 54, which effectively held the electrode regions 55, 56 in a vice-like grip while the electrode 50 was contracting. Because of the inability of the groove 51 to withstand the axial forces $F_A$, the groove 51 developed into a crack 52 travelling through the body of the electrode 50, so that the electrode 50 (and therefore its lamp) is rendered useless.

Figure 5:
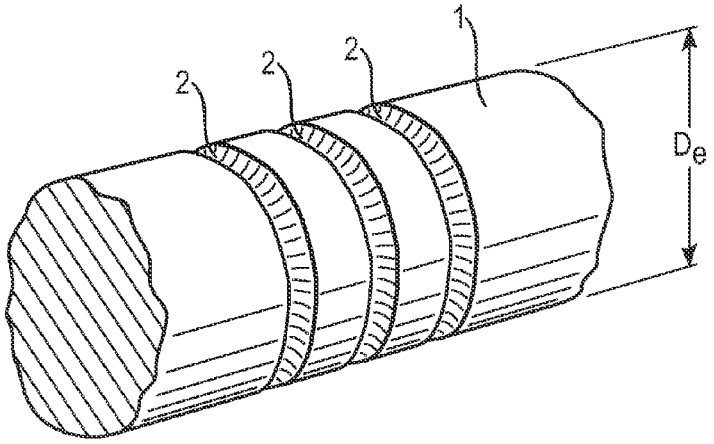
FIG. 5 shows an enlarged schematic view of a first embodiment of an electrode according to the invention.
Figure 6A:
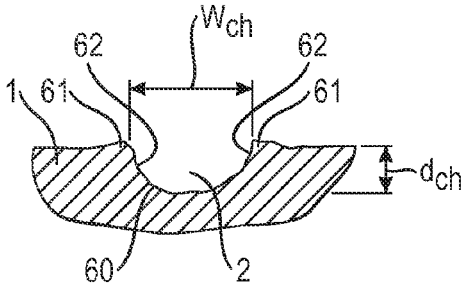
FIG. 6*a* shows a cross-section of the electrode of FIG. 5.
Figure 6B:
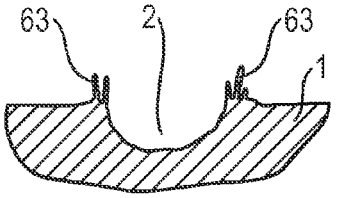
FIG. 6*b* shows a cross-section of a second embodiment of an electrode according to the invention.

FIG. 5 shows an enlarged schematic view of an electrode 1 according to the invention, with a diameter $D_e$ of 400 μm. The diagram clearly shows the U-shaped channel 2 running along the surface of the electrode in a helical fashion. FIG. 6*a* shows a cross-section of the electrode 1 of FIG. 5, in which the geometry of the channel 2 is more clearly shown. Here, the channel 2 has a channel width $w_{ch}$ of 30 μm and a channel depth $d_{ch}$ of 20 μm. The walls of the channel taper towards the channel floor 60, and the channel floor 60 is curved with a radius $r_{ch}$ of 7.5 μm. Here, the ratio of channel width $w_{ch}$ to channel depth $d_{ch}$ is 30:20 or 1.5:1, and the ratio of channel width $w_{ch}$ to channel diameter $2r_{ch}$ is 30:15 or 2:1. The ratio of channel depth $d_{ch}$ to electrode diameter $D_e$ is 20:400, i.e. the channel depth is only 5% of the electrode diameter. The dimensions given here are only exemplary, so that other dimensions are possible, of course. For example, for an electrode with a diameter of 400 μm, a channel depth of 6 μm would yield a ratio of channel depth $d_{ch}$ to electrode diameter $D_e$ of 6:400, or about 1.5%. For the increased resilience of the electrode to breakages during cooling, it is only important that the dimensions satisfy the relationships already described in the above. FIG. 6*b* shows an alternative embodiment of the electrode 1 according to the invention, in which the material of the electrode 1 has been converted or transformed during a laser treatment step to give a series of bristle-like or brush-like protrusions 63 along the transition between channel 2 and electrode outer surface.

Figure 7:
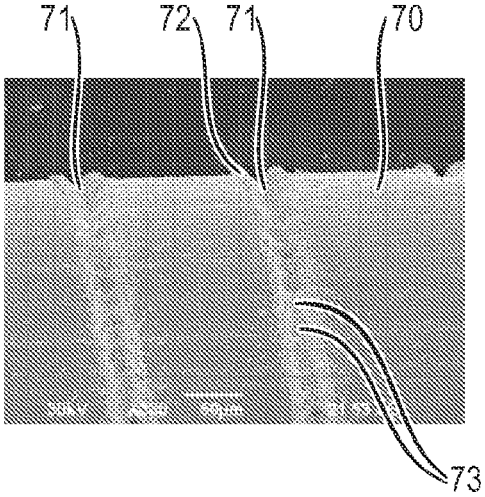
FIG. 7 shows a scanning electron microscope image of a prior-art grooved electrode at a magnification of 330 times.
Figure 8:
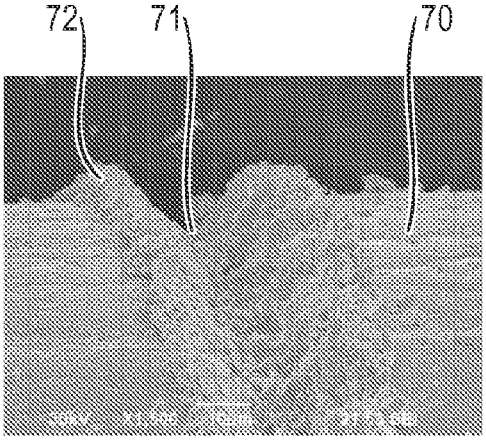
FIG. 8 shows a scanning electron microscope image of a groove in a prior-art electrode, at a magnification of 1500 times.

FIG. 7 shows a scanning electron microscope image of a prior-art grooved electrode 70 at a magnification of 330 times. The grooves 71 have been 'gouged' out of the surface of the electrode 70 by a laser beam. The material of the electrode 70 displaced to form the grooves 71 is deposited to give clearly raised walls 72 on either side of the grooves 71, as shown in FIG. 8, a magnification of one groove 71 at 1500 times. Furthermore, the grooves 71 have clearly visible 'pits' 73 or deep holes 73. Any of these pits 73 can result in the electrode 71 acting as a notched tensile specimen when the electrode 70 is cooled during manufacture, and may contribute to the failure of the electrode 70 in the manner described above, so that the electrode 70 does not survive the manufacturing process.

Figure 9:
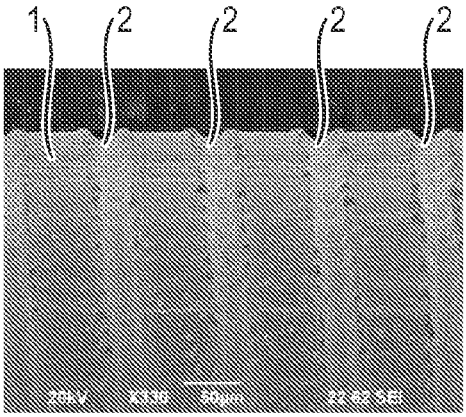
FIG. 9 shows a scanning electron microscope image of an electrode with channels according to the invention, at a magnification of 330 times.
Figure 10:
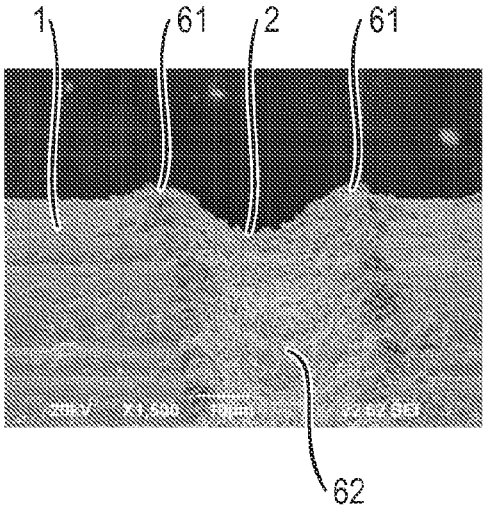
FIG. 10 shows a scanning electron microscope image of a channel of an electrode according to the invention, at a magnification of 1500 times.

In contrast, FIG. 9 shows a scanning electron microscope image of an electrode 1 with channels 2 according to the invention, also at a magnification of 330 times. This image clearly shows that the channels 2 are smoothly formed, and that there are no pits or marked unevenness on the lower surface or floor of the channels 2, unlike in the prior art grooved electrode of FIGS. 7 and 8. This is shown in more detail in FIG. 10, which is an image, magnified 1500 times, of a single channel 2 in an electrode 1 according to the invention. This image also shows the favorable low ridges 61 on either side of the channel 2. The smoothness or regularity of the channel floor 62 can be clearly seen. Since there is effectively no 'pit', 'hole' or other similar irregularity on the channel floor that would act as a notch, the channels 2 ensure that this inventive electrode 1 is much less likely to suffer breakage during cooling in manufacture, so that the production yield can be increased.

Figure 11:
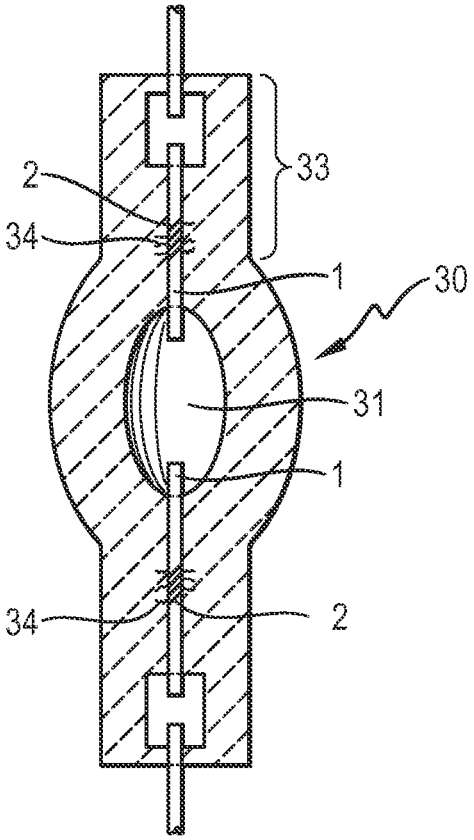
FIG. 11 shows a gas-discharge lamp according to the invention.

FIG. 11 shows a gas-discharge lamp 3 according to the invention, made of a quartz glass envelope 30, with a pair of electrodes 1 extending at their tips into a discharge chamber 31. The base of each electrode 1 is held in a sealed portion 33. The channels 2, made using any of the techniques described above, are shallow, essentially concave channels 2, indicated here only by the parallel slanted lines. During the cooling step in manufacture, the quartz glass and electrode metal cooled at different rates, and therefore contracted at different rates. The favorable geometry of the channels 2 allowed the controlled formation of micro-cracks 34 or relief cracks 34, shown here enlarged for the sake of clarity. These relief cracks 34 prohibit or restrict the development of spontaneous large bead cracks resulting in RECs.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art from a study of the drawings, the disclosure, and the appended claims. For the sake of clarity, it is to be understood that the use of "a" or "an" throughout this application does not exclude a plurality, and "comprising" does not exclude other steps or elements. The mere fact that certain measures are recited in mutually different dependent claims does not indicate that a combination of these measures cannot be used to advantage. Any reference signs in the claims should not be construed as limiting the scope.

The invention claimed is:

1. A lamp comprising a quartz glass envelope enclosing a chamber, the lamp including an electrode, wherein the electrode comprises:

a tip for extending into the chamber; and a base for embedding in a sealed portion of the quartz glass envelope, characterized in that the base comprises a plurality of essentially smooth U-shaped concave channels, each channel being arranged circumferentially around a body of the electrode, wherein each channel comprises side walls and a concave channel floor, and wherein the depth ($d_{ch}$) of a channel is not greater than 8 percent of a diameter ($d_e$) of the electrode, wherein the glass envelope contacts at least some of the channels in the completed lamp, and wherein the glass envelope includes relief cracks neighboring the base in the completed lamp during manufacturing of the lamp.

2. The lamp according to claim 1, wherein the ratio of channel width to channel depth is not greater than 8:1.

3. The lamp according to claim 1, wherein the ratio of channel width to a diameter of the channel floor is not greater than 10:1.

4. The lamp according to claim 1, wherein, at a transition between the surface of the electrode and a channel, material of the electrode is deposited to form a plurality of brush-like protrusions.

5. The lamp according to claim 1, wherein, at a transition between the surface of the electrode and a channel, material of the electrode is deposited to form a low ridge with a height of not greater than 20 μm.

6. The lamp according to claim 1, wherein the plurality of channels comprises a helical channel around the body of the electrode.

7. The lamp according to claim 1, wherein the base comprises a region treated to comprise a plurality of channels, which channel region is flanked on at least one side by an untreated region in which the surface of the electrode is essentially smooth.

8. The lamp according to claim 1, wherein the depth of a channel is not greater than 3 percent of a diameter of the electrode.

9. The lamp according to claim 1, wherein the ratio of channel width to channel depth is not greater than 2:1.

10. The lamp according to claim 1, wherein the ratio of channel width to a diameter of the channel floor is not greater than 1:1.

11. A lamp comprising a quartz glass envelope enclosing a chamber and a pair of electrodes disposed to extend into the chamber from opposite sides, wherein each electrode is partially embedded in a sealed portion of the quartz glass envelope, wherein each electrode comprises:

a tip for extending into the chamber; and a base for embedding in a sealed portion of the quartz glass envelope, characterized in that the base comprises a plurality of essentially smooth U-shaped concave channels, each channel being arranged circumferentially around a body of the electrode, wherein each channel comprises side walls and a concave channel floor, wherein the glass envelope contacts at least some of the channels in the completed lamp, and wherein the glass envelope includes relief cracks neighboring the base in the completed lamp during manufacturing of the lamp.

12. A lamp according to claim 11, the lamp being a gas-discharge lamp, and wherein the electrodes comprise tungsten rods with a diameter in the range of 200 μm to 500 μm and are disposed in the lamp such that tips of the electrodes extend into the discharge chamber from opposite sides, and the other end of each electrode is embedded in the sealed portion of the lamp such that channels arranged around the body of the electrode are enclosed in the sealed portion.

13. The lamp according to claim 11 wherein, at a transition between the surface of the electrode and a channel, material of the electrode is deposited to form a substantially smooth low ridge with a height of not greater than 20 μm, wherein a space between adjacent low ridges is substantially smooth.

14. The lamp according to claim 13, wherein, at the transition between the surface of the electrode and a channel, material of the electrode is deposited to form the low ridge with a height of not greater than 6 μm.

* * * * *